US005884596A

United States Patent [19]

Hara et al.

[11] Patent Number: 5,884,596

[45] Date of Patent: Mar. 23, 1999

[54] VALVE SPRING IN AN INTERNAL COMBUSTION ENGINE

[75] Inventors: Nobuo Hara; Makoto Abe, both of Fujisawa, Japan

[73] Assignee: Fuji Oozx, Inc., Kanagawa-ken, Japan

[21] Appl. No.: 78,088

[22] Filed: May 13, 1998

[51] Int. Cl.[6] ..... F01L 3/10

[52] U.S. Cl. ..... 123/90.65; 123/188.12; 123/188.17; 251/337

[58] Field of Search ..... 123/90.65, 90.66, 123/90.67, 188.12, 188.13, 188.17; 251/337; 267/174, 179

[56] References Cited

U.S. PATENT DOCUMENTS

| | | | |
|---|---|---|---|
| 4,470,383 | 9/1984 | DeBolt | 123/90.65 |
| 4,993,376 | 2/1991 | Fukutome et al. | 123/90.65 |
| 5,381,765 | 1/1995 | Rhodes | 123/90.67 |
| 5,445,115 | 8/1995 | Murata et al. | 123/90.65 |

*Primary Examiner*—Weilun Lo

*Attorney, Agent, or Firm*—Oppenheimer Wolff & Donnelly LLP

[57] ABSTRACT

A valve spring is used in a valve operating mechanism for moving a poppet valve up and down in an internal combustion engine of an automobile. The terminal end of the uppermost portion of the valve spring extends in a tangential direction to go away from an axis of the valve spring, thereby avoiding contact with a retainer to prevent wear.

1 Claim, 2 Drawing Sheets

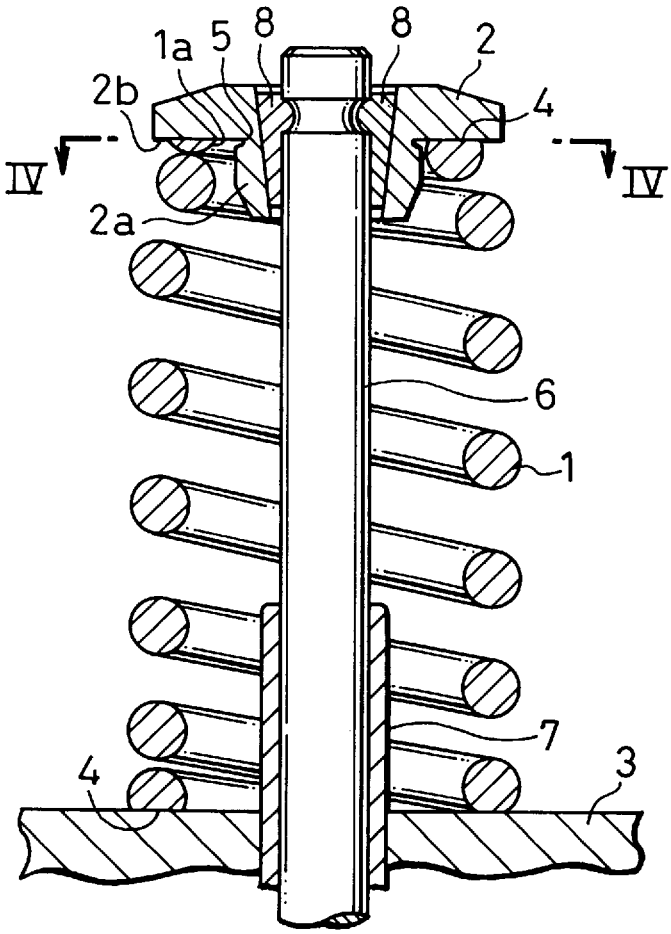
FIG. 3
PRIOR ART
FIG. 4
PRIOR ART
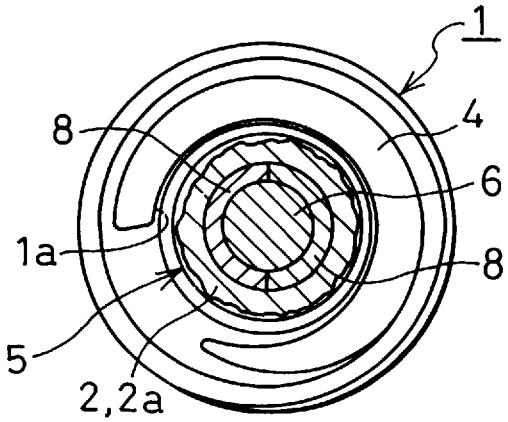

VALVE SPRING IN AN INTERNAL COMBUSTION ENGINE

BACKGROUND OF THE INVENTION

The present invention relates to a valve spring used in a valve operating mechanism of an internal combustion engine for a vehicle such as an automobile.

As illustrated in FIG. 3, to decrease inertia mass of the valve operating mechanism, a coil valve spring 1 used in a valve operating mechanism of an internal combustion engine is formed like a frustum.

The upper and lower surfaces of the valve spring 1 are flat to contact the lower surface of a retainer 2 and the upper surface of a cylinder head 3 respectively, as shown in FIG. 3. In the frusto-conical valve spring 1, a diameter of an uppermost winding is smaller, so that a horizontal distance with a tubular portion of the retainer 2 becomes smaller. Thus, as illustrated in FIG. 3, the valve spring 1 vibrates in a lateral direction owing to surging, so that an inner circumferential edge 1*a* vigorously comes in contact with an inner corner 5 between the tubular portion 2*a* and a receiving surface 2*b*, thereby causing wear. As the inner corner 5 between the tubular portion 2*a* and the receiving surface 2*b* is subjected to large bending stress, wear thereon is unsuitable. The numerals 6, 7 and 8 denote a poppet valve, a valve guide and a pair of cotters respectively.

SUMMARY OF THE INVENTION

In view of the disadvantage, it is an object of the present invention to provide a valve spring in which the terminal end is changed in form, thereby preventing wear of a retainer.

According to the present invention, there is provided a valve spring in an internal combustion engine, said valve spring comprising a coil which is tapered upward, an upper surface of the coil being formed flat, a terminal end of said coil extending in a tangential direction to go away from an axis of the coil.

The terminal end of the coil extends away from the axis of the coil, thereby decreasing possibility of contact of the inner circumferential edge with a retainer to keep wear at minimum.

BRIEF DESCRIPTION OF THE DRAWINGS

The features and advantages of the present invention will become more apparent from the following description with respect to embodiments as shown in the drawings wherein:

FIG. 3 is a vertical sectional view of a valve operating mechanism which contains a conventional valve spring; and FIG. 4 is a sectional plan view taken along the line IV—IV in FIG. 3.

DETAILED DESCRIPTION OF PREFERRED EMBODIMENTS

Figure 1:
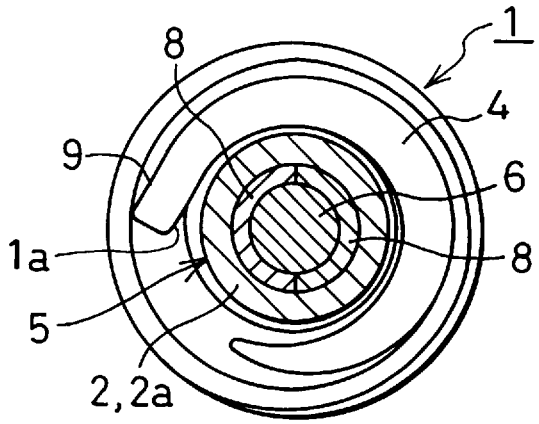
FIG. 1 is a sectional plan view of the first embodiment of a valve spring according to the present invention taken along the surface which contacts a retainer.

FIG. 1 illustrates the first embodiment of the present invention, in which the uppermost surface 4 of a frusto-conical valve spring 1 is flat, and a terminal end 9 extends in a tangential direction to go away from an axis of the valve spring. Thus, a distance between an inner circumferential edge 1*a* and a tubular portion 2*a* of a retainer 2 is increased, thereby decreasing possibility that the terminal end 9 comes in contact with a corner 5 between the tubular portion 2*a* and a receiving surface (not shown) and keeping wear thereon at minimum.

Figure 2:
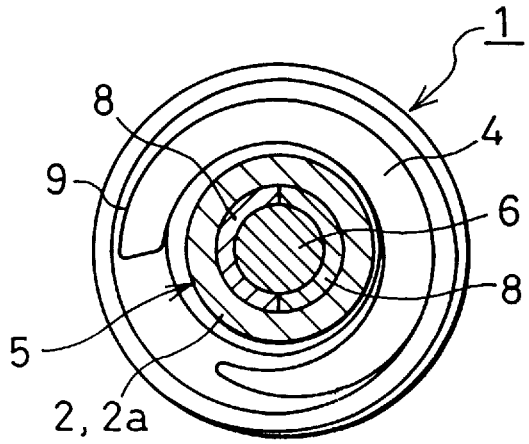
FIG. 2 is a sectional plan view of the second embodiment of a valve spring seen from the same position as in FIG. 1.

FIG. 2 illustrates the second embodiment of the present invention, in which a terminal end 9 extends at almost the same curvature as the lowermost portion of a valve spring 1, thereby improving yield of the valve spring 1. After a valve spring 1 is wound up, a wire is cut off at the terminal end. To begin to wind a next wire, it is necessary to cut off the beginning end by a predetermined length in the tangentially ending wire as illustrated in the first embodiment, but the second embodiment saves the wire since it is possible to begin to wind up a next valve spring at once.

The foregoing merely relate to embodiments of the present invention. Various changes and modifications maybe made by persons skilled in the art without departing from the scope of claims wherein:

What is claimed is:

1. A valve spring in an internal combustion engine, said valve spring comprising a coil which is tapered upward, an upper surface of the uppermost portion of the coil being flat, a terminal end of said uppermost portion of said coil extending at almost the same curvature as a lowermost portion of the coil.

* * * * *